United States Patent [19]

Bubley et al.

[11] 4,031,824

[45] June 28, 1977

[54] SHEET FEED AND TAKEOFF ASSEMBLY FOR PRINTERS

[75] Inventors: Henry J. Bubley, Deerfield; John R. Krutsch, Glenview, both of Ill.

[73] Assignee: American Screen Printing Equipment Company, Chicago, Ill.

[22] Filed: Nov. 3, 1975

[21] Appl. No.: 628,151

[52] U.S. Cl. ..... 101/126; 101/408; 271/85; 271/194; 271/268

[51] Int. Cl.[2] ..... B41F 15/20; B41F 15/22

[58] Field of Search ..... 101/123, 124, 126, 118, 101/232, 408, 409, 410; 271/84, 85, 194, 204, 267, 268, 277; 198/179, 180, 486

[56] References Cited

UNITED STATES PATENTS

| | | | |
|---|---|---|---|
| 2,413,553 | 12/1946 | Evers | 271/194 X |
| 2,606,492 | 8/1952 | Black | 101/124 |
| 3,384,010 | 5/1968 | Cotterell | 101/126 X |
| 3,809,390 | 5/1974 | Lenoir | 198/180 X |
| 3,888,359 | 6/1975 | Moline | 271/267 X |

*Primary Examiner*—Edward M. Coven
*Assistant Examiner*—R. E. Suter
*Attorney, Agent, or Firm*—Robert E. Wagner; Robert E. Browne; Gerald T. Shekleton

[57] ABSTRACT

A feed and takeoff assembly particularly adapted for use in connection with a printing press to automatically transfer generally flat stock from a first position to a print position and to a delivery position, having a frame, a transfer carriage mounted for movement along the frame, a single elongated feed gripper mounted near one end of the transfer carriage and disposed transversely to the path of travel of the carriage along the frame, and a delivery gripper mounted near the opposite end of the transfer carriage for movement therewith along the frame. The single elongated feed gripper is maintained in constant registered position during movement along the frame by a spring-biased cam-operated guide means. The delivery gripper acts to remove an entire sheet of printed stock at a desired time by a cam-operated opening and closing of upper and lower jaws mounted on a common pivot print. The operation of the transfer carriage and associated feed gripper and delivery gripper relative to the operation of the printing press is timed by a plurality of control cams which provide for feeding and delivery of stock and return of the carriage at optimum speeds without errors in registration.

5 Claims, 9 Drawing Figures

FIG. 4
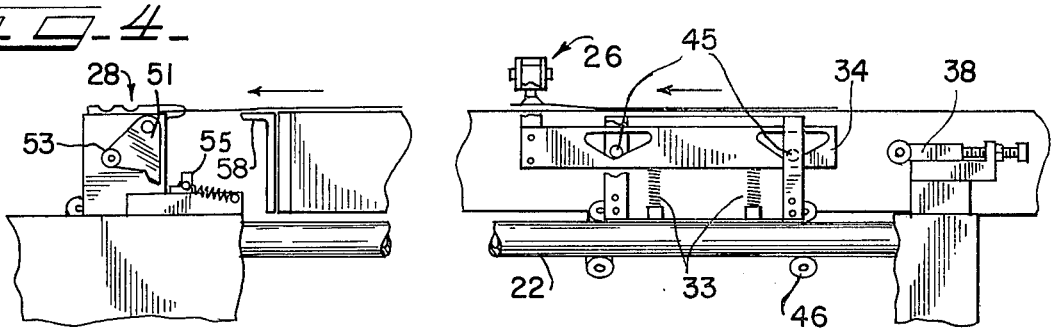
FIG. 6
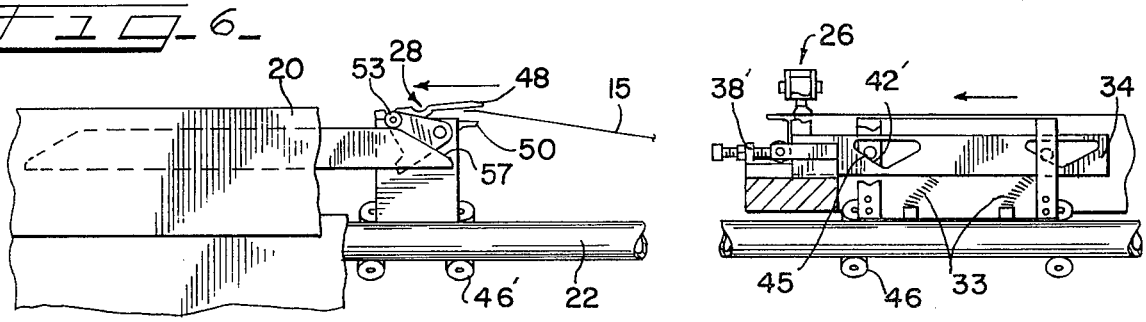
FIG. 8
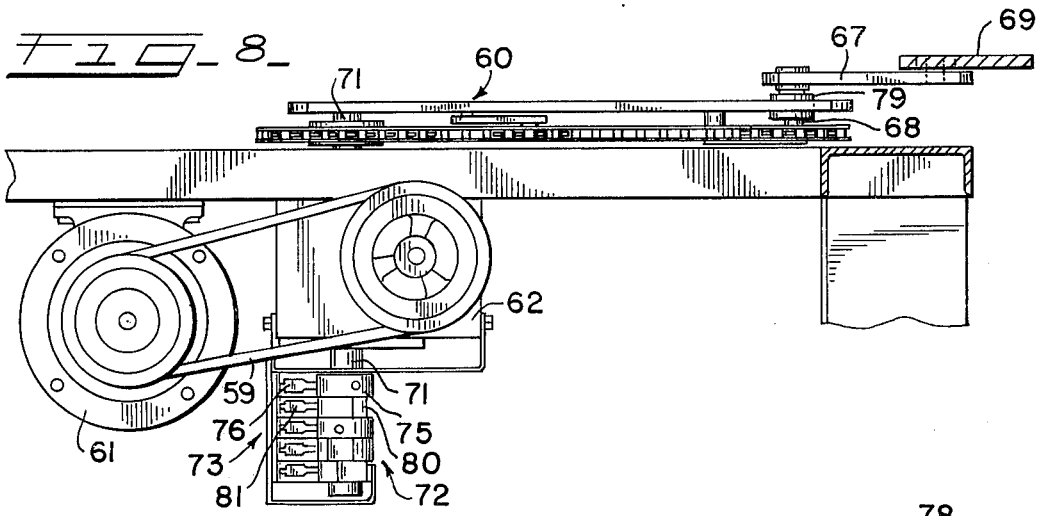
FIG. 7
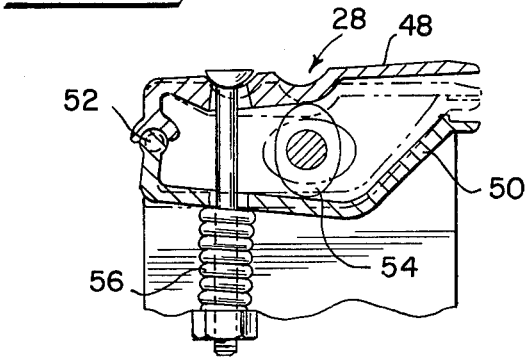
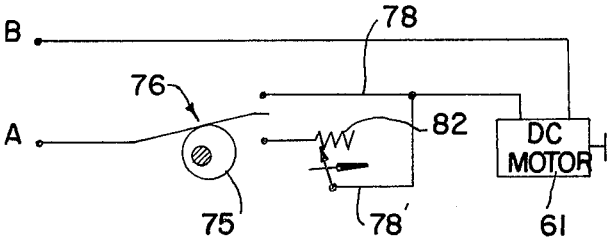
FIG. 9

SHEET FEED AND TAKEOFF ASSEMBLY FOR PRINTERS

BACKGROUND OF THE INVENTION

A feed and takeoff assembly particularly adapted to transfer sheet shock from a first location, to a second location, to a third location, particularly in combination with the operation of a screen printing press.

The screen printing of the various types and thicknesses of paper and metal stock used in business, advertising and innumerable other applications has increased dramatically in the last few years. The demand for this type of printing often requires high-volume production which, in turn, demands efficiency in the printing process. The automatic and semi-automatic screen printing presses used in this type of work generally include a frame having a printing bed and a pivoting printing head mounted on the frame and holding a screen for placement over the printing bed above the stock to be printed which is placed thereon.

In order to achieve production efficiency and acceptable quality in large volume models of such presses, some kind of automatic or at least semi-automatic device to feed stock to or remove and deliver it from the press is critical. However, there is presently a lack of simple, inexpensive, reliable automatic equipment for feeding, registering and removing stock in connection with a printing press. Therefore, feeding and registering is often done by hand; the press is then activated; and, at best, an automatic takeoff, such as that shown in U.S. Pat. No. 3,860,231 to Claude H. Oltra and manufactured by American Screen Printing Equipment Company of Chicago, Illinois, is used to automatically remove the stock.

There are also presently available complex systems of mechanical finger-type grippers which are built directly into the printing press to accomplish feeding, registration and delivery. These devices usually include three or more individual series of independently-operating grippers. One gripper set feeds, one gripper set registers, and two or more gripper sets act to remove the stock from the printing area and deliver it to a final position. Such gripper series are independent of one another and moved by a complex mechanical system of chains and linkages. They must be independently adjusted for various thicknesses and sizes of stock being printed. The expense of such equipment is prohibitive for small firms, and the cost of maintenance, because of possible breakdown and readjustment, is often high.

SUMMARY OF THE INVENTION

The present invention relates to a unitary, automatic feed and takeoff assembly which may be used alone or in conjunction with a screen printing press to provide a reliable, efficient and relatively low-cost means of automatically feeding, registering and delivering stock in a printing operation.

The present invention overcomes the problems of the prior art through the use of a single elongated feed gripper member and a single elongated delivery gripper member, which are mounted in spaced relationship on a transfer carriage assembly movable relative to the printing bed of a printing press on a frame having a pair of parallel spaced rails. The feed gripper member and delivery gripper member are maintained in spaced, parallel relationship near opposite ends of the transfer carriage and move with the transfer carriage as a single unit relative to the printing bed.

In operation, the stock to be printed may be first registered to the outside of the printing bed of the press and the feed gripper member, being mounted on a spring-biased cam-operated mounting plate moved horizontally and vertically relative to the stock to be printed to pick it up by vacuum in a registered position. The transfer carriage then moves along the rails of the frame so that the stock is brought into a printing position by the feed gripper. As the feed gripper is moving toward the printing bed, the delivery gripper, consisting of a pair of elongated, parallel jaws which open in opposite directions about a common pivot pin, has simultaneously engaged and gripped a protruding edge of a sheet of printed stock and begun to transfer such stock to a delivery position.

After feeding and delivery has been accomplished, the transfer carriage may be quickly returned to its initial position and begin to repeat the process. The operation of the printing press is preferably timed so that printing is accomplished during return of the transfer carriage.

The unified movement and constant spacing of the feed gripper and the delivery gripper assures reliable, repeated operation of the feed and takeoff assembly since each piece of stock will always be in proper position after feeding for removal from the printing bed by the delivery gripper. In other words, if a piece of stock can be gripped for feeding, it will be gripped for delivery. The use of a single feed gripper member, which is controlled and limited in its independent vertical and horizontal movement, assures that each piece of stock will always be brought into proper registered position for printing and permit accurate multicolor printing. The use of a single, elongated delivery gripper member in combination with a dropping edge of the printing bed assures that even the heaviest piece of stock may be gripped along an entire edge for proper removal.

The linear movement of the transfer carriage on which the feed and delivery grippers are mounted is controlled by a DC motor, whose speed is in turn controlled by one or more switching cams which rotate with the movement of the transfer carriage. The length of travel of the transfer carriage may be varied by adjustment of a unique crank drive means connecting the DC drive motor to the transfer carriage which also provides a harmonic motion to the transfer carriage in its feeding movement.

Accordingly, it is an object of the present invention to provide a feed and takeoff assembly which automatically and simultaneously transfers stock from a first position to a printing position and a delivery position.

It is a further object of the present invention to provide a feed and takeoff assembly in which the feed gripper and delivery gripper are connected so that they move together as a unit to thereby eliminate registration, adjustment and pick-up problems and reduce the number of parts in the apparatus.

It is another object of the present invention to provide a feed and takeoff assembly having a single feed gripper member which is controlled in its independent vertical and horizontal movement so that it both feeds and registers stock accurately.

It is one more object of the present invention to provide a feed and takeoff assembly having a delivery gripper including upper and lower jaws which close over substantially the entire length of an edge of the stock to be removed to assure proper gripping and removal.

It is still another object of the present invention to provide a feed and takeoff assembly operable at variable speeds to permit maximum efficiency without registration errors or gripping problems.

These and other objects of the present invention will become more apparent from the following detailed description of the invention taken in conjunction with the drawings wherein:

FIG. 4 is a front side elevational, partially cut-away view of the feed and takeoff assembly of the present invention, similar to that shown in FIG. 3, wherein the transfer carriage is feeding stock toward the printing bed of the printing press and removing printed stock from the printing bed of the printing press;

Figure 2:
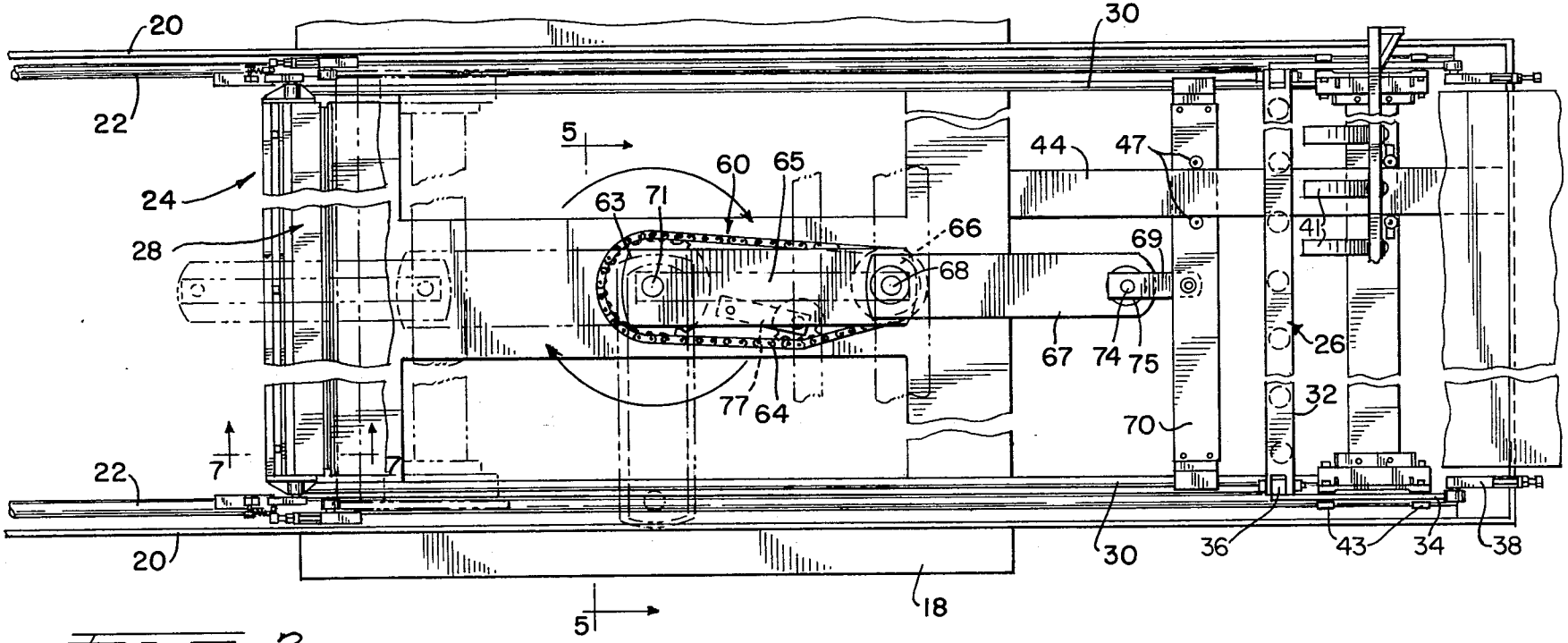
FIG. 2 is a top plan view of the feed and takeoff assembly of the present invention with the printing bed of the screen printing press removed to show the features of the present invention.

FIG. 6 is a front elevational view, partially cut-away, of the feed and takeoff assembly of the present invention showing the transfer carriage in the extreme left-hand position where the feed gripper member is depositing the stock to be printed on the printing bed of the printing press and the delivery gripper member is depositing the stock which has been printed in a selected third delivery position;

FIG. 7 is a vertical cross-sectional view of the delivery gripper member of the present invention taken generally along line 7—7 of FIG. 2;

FIG. 8 is a front, vertical cross-sectional view of a portion of the feed and takeoff assembly of the present invention showing the feed and takeoff drive motor, the cam controls and the crank drive means connecting the drive motor to the transfer carriage; and, FIG. 9 is a simplified circuit diagram showing as electrical control circuit for regulating the speed and movement the transfer carriage of the present invention.

DETAILED DESCRIPTIONS OF THE DRAWINGS

Figure 1:
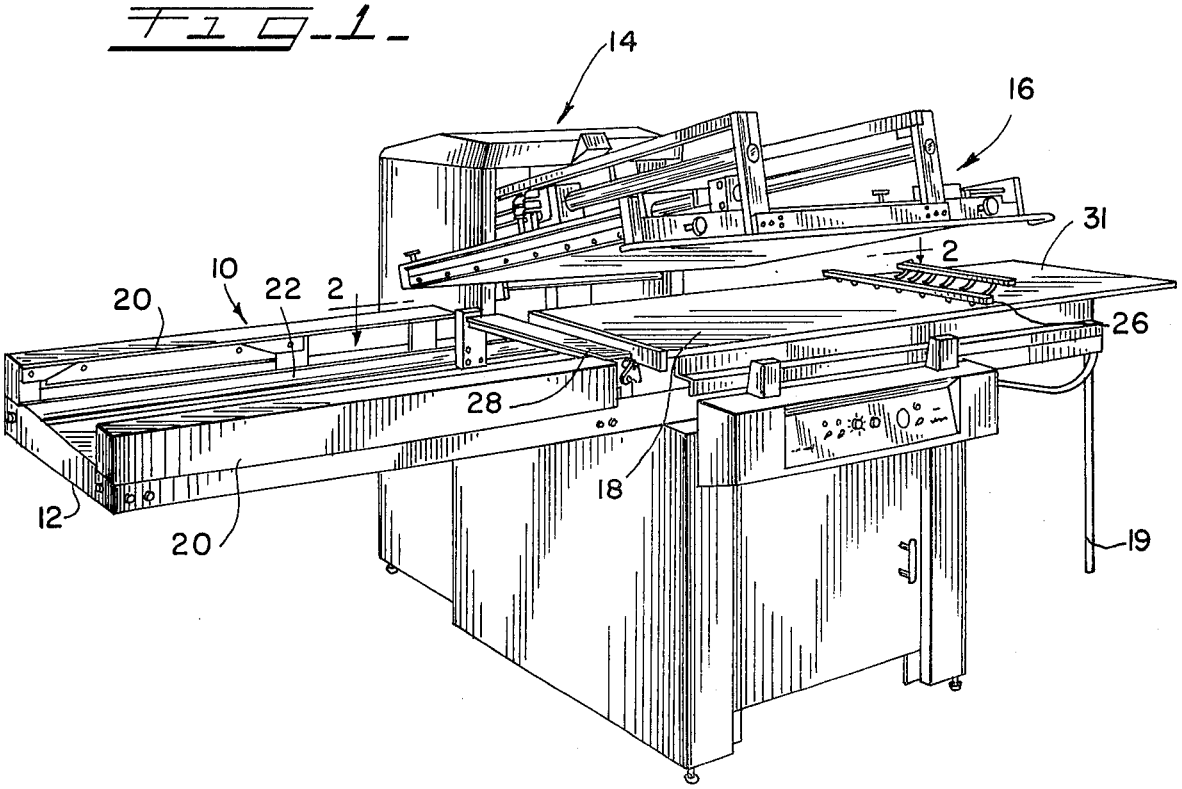
FIG. 1 is a perspective view of the feed and takeoff assembly of the present invention mounted for use on a screen printing press.

Referring now to the drawings, and in particular, to FIG. 1, the feed and takeoff assembly of the present invention is shown in general at 10 mounted in combination with a screen printing press 14. The feed and takeoff assembly 10 includes an elongated frame 12 which is mounted horizontally across and at right angles to the printing bed 18 of the screen printing press 14. While the screen printing press 14 may be any commercially available type, having a printing head 16 which drops vertically over a printing bed, or as shown in FIG. 1, pivots toward and away from the printing bed 18, the press shown is manufactured by American Screen Printing Equipment Company of Chicago, Illinois, and is fully described in U.S. Pat. No. 3,955,501, issued May 11, 1976 by Henry J. Bubley and Claude H. Oltra. The disclosure of that application is incorporated herein in its entirety by this reference thereto.

The frame 12 of the feed and takeoff assembly 10 includes a pair of generally parallel side support members 20 and a pair of generally parallel end support members 21 joined to form a boxlike structure, supported on one end by a vertical leg 19 and cantilevered to extend away from the printing bed 18 and the printing press 14 at the opposite end. As previously stated, this support frame is placed across the printing bed 18, and, for operation with press 14, is normally mounted across and under a vacuum-type printing bed, as will be described below. Within the side support members 20, and parallel thereto, are a pair of parallel tubular rails 22 extending the length of the support frame 12. These rails 22 are maintained in constant-spaced relationship along the length of the frame 12. A feed and takeoff carriage 24, which will be described in detail below, is mounted on these rails for free movement therealong relative to the printing bed 18 and the printing press 14.

Carriage 24 includes an elongated feed gripper 26 mounted near the right-hand end thereof, as viewed in the drawings, and an elongated takeoff gripper 28 mounted near the opposite, or left-hand, end thereof. A pair of parallel spaced connecting rods 30 connect feed gripper 26 to takeoff gripper 28 as shown in FIG. 2. These connecting rods 30 are joined to one another by a transverse stabilizing member 70. The carriage 24 thus formed maintains the feed gripper 26 and takeoff gripper 28 is constantly spaced parallel relationship.

The feed gripper 26, in the preferred embodiment, includes a hollow elongated support bar 32 mounted transverse to the path of travel of the carriage 24, and having a plurality of ports (not shown) formed in it which are connected through suitable conduit to a vacuum source. The ports terminate in a series of suction cups 37 which project downwardly toward a first location 31 of stock to be transferred to the printing bed 18. This first location is shown in FIG. 1, as the surface of the right-hand outward extension of the feed and takeoff frame 12.

Figure 5:
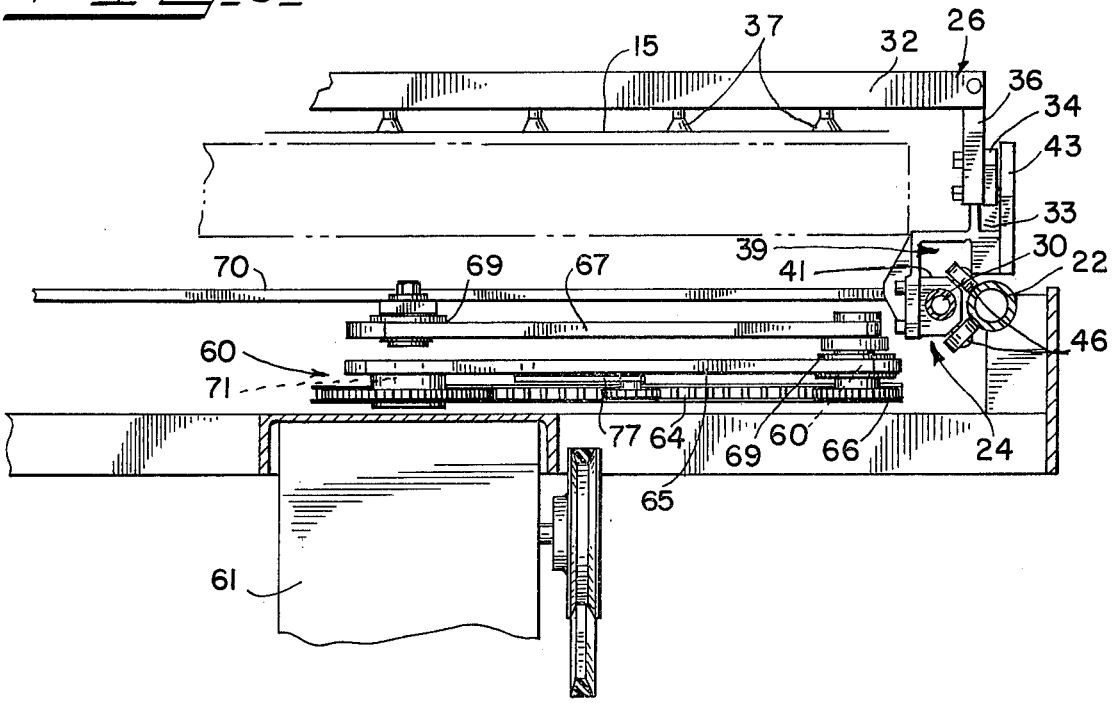
FIG. 5 is a transverse cross-sectional elevational view of the feed and takeoff apparatus of the present invention, showing the feed gripper member in the position of FIG. 4, and taken generally along line 5—5 of FIG. 2.

Feed gripper 26 is supported, at each end, by support post 36 fixedly attached to registration plates 34 (FIG. 5). Each registration plate 34 has a pair of spaced triangular shaped openings 35 formed in it which are mounted over a pair of spaced outwardly projecting pins 45 (FIG. 3) formed on a mounting plate 38, which, in turn, forms the upper portion of a right-hand truck assembly 39. Truck assembly 39 also includes a main body 41 and a plurality of outwardly angled, low-friction rollers 46 which contact rails 22 and allow the entire carriage to move relative to the rails. A pair of horizontally disposed rollers 47 ride against opposite sides of a central stabilizing rail 44 to offset any lateral forces created by movement of the segmented driving crank 60 or the transfer carriage 24 (FIG. 2).

Figure 3:
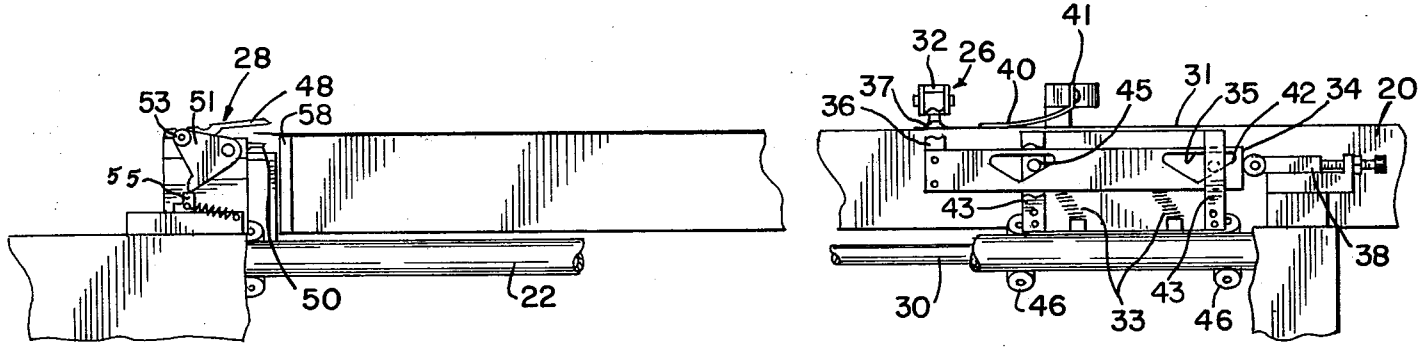
FIG. 3 is a front elevational, partially cut-away view of the feed and takeoff assembly of the present invention, showing, in particular, the detail at the opposite ends of the frame of the present invention with the transfer carriage in position for gripping stock to be printed and to deliver stock which has been printed.

Each registration plate 34 is constantly urged upwardly against pins 45 by a pair of spring 33 or equivalent resilient means so that feed gripper 26 and its suction cups 37 are normally spaced above the surface of the feed and takeoff assembly 10, and above first position 31 in which the stock 15 is to be printed is maintained. A pair of outer cap bars 43 are positioned over the ends of pins 45 so that the registration plate 34 is retained between bars 43 and past 36, as shown in FIGS. 2 and 3. Registration plate 34 is shifted relative to camming pins 45 it is moved into engagement with an adjustable stop 38 mounted at the end of rail 22. The surfaces of the triangular openings in the registration plate 34 are moved over the camming pins45 to provide constant, repeated, similar movement of the elongated feed gripper 26 in both horizontal and vertical directions relative to the first or pickup position of the stock to be printed. In operation, when the end of registration plate 34 engages stop 38, the inclined cam following surface 42 of each opening 35 will be moved downwardly vertically by the still forwardly moving cam pins 45. In other words, the feed gripper 26 will, as the truck assembly 39 reaches the end of the rail 22 adjacent first position 31, be moved vertically relative to the surface of the first position so that it comes into contact with the stock positioned thereon in an identical manner and in an identical registered position with each cycle of the feed and takeoff assembly. An elongated stock holddown apparatus 40 is mounted transversely across the first position 31 in which the stock to be printed is maintained, and has a plurality of spring fingers 41 pressing downwardly upon the top of the stock to be printed to maintain it in a desired position and location relative to the printing bed 18 (FIG. 2).

The takeoff gripper 28 is rigidly connected to the feed gripper 26 by the connecting rods 30 or similar means attached to their respective truck assemblies 39 which ride on rails 22 (FIG. 3). Takeoff gripper 28 is actuated at the same time as feed gripper 26 to remove a piece of stock which has been printed on printing bed 18 from the printing bed. Thus, takeoff gripper 28 opens and closes at the same time the feed gripper 26 is contacting and gripping by vacuum the piece of stock to be printed. Takeoff gripper 28 includes an upper jaw 48 and a lower jaw 50, which are movable in opposite directions on a common pivot rod 52 extending their length, and transversely to their path of travel. Jaws 48 and 50 are separated by an internal arm 54 operated by an outer cam follower 51 which is tripped by a spring returned dog 55 maintained in a fixed position on the frame 12 (FIG. 7). The takeoff gripper jaws 48 and 50 which are urged to a normally closed position by spring 56, operate in conjunction with a dropping edge 58 of printing bed 18, which, upon cam activation of the internal arm 54, is moved downwardly to reveal an outside edge of the stock which has been printed (FIGS. 3 and 4). This dropping edge 58 enables the entire surface of the stock to be supported and printed but also relieves the tendency of the stock to stick to the bed of the printing press after printing, and affords a significant gripping edge so that the takeoff gripping jaws will securely engage the stock after printing.

As can be appreciated from the above description, a significant feature of this invention is that only two grippers are used to feed, register, and remove stock, relative to a printing press. These two grippers extend transversely to their path of travel and are integrally or rigidly connected to each other so that they move simultaneously and in constant spaced relationship with one another. Thus, there is never any need to register or adjust one gripper with respect to the other, or to register the feed gripper with respect to the edge of the printing bed.

The invention also involves an unique apparatus for regulating the speed at which the transfer carriage 24 and the feed and takeoff grippers mounted thereon move. Transfer carriage 24 is moved by a feed and takeoff drive motor 61 which is completely independent of any motor associated with the press, but is in electrical communication therewith, so that the operation of the printing head of the press and the infeed and takeoff assembly may be synchronized. This motor is directly connected by a drive belt 59 shown in FIG. 8, to a reduction assembly 62, having an output shaft 71, which in turn drives a segmented drive crank 60, as will be explained below.

The drive crank 60 includes a rotating main drive gear or sprocket 63 mounted on shaft 71 FIG. 2). Shaft 71 also has fixedly mounted, on its upper end, one end of an elongated first drive arm 65 which moves angularly with the main drive gear 63. At the opposite, outer end of first drive arm 65 is mounted a second perpendicular shaft 68 which extends therethrough. At the bottom end of shaft 68 is fixedly mounted a second driven gear or sprocket 66. This second driven gear 66 is connected to the main drive gear 63 by a link chain 64 so that movement of main drive gear 63 will produce corresponding movement of driven gear 66 to rotate shaft 68 freely within a bushing 79 through drive arm 65. At the opposite end of second shaft 68 is mounted a second arm 67 which rotates with shaft 68 and second driven gear 66. Thus, as the main drive gear rotates in a clockwise direction, and along with it the first drive arm 65, the second driven gear 66 and second drive arm 67 are rotated in a counterclockwise direction so that shaft 68 is moved toward shaft 71. At the opposite or outer end of second arm 67, a hitch arm 69 is mounted on a third shaft or pin 74 which is free to move within a bushing 75 mounted in second arm 67. Hitch arm 69 is attached to its opposite end in a fixed manner to a transverse stabilizer member 70 which forms part of the transfer carriage.

The action of the driving crank assembly 60 is shown in the solid and hidden lines in FIG. 2. It is seen that the arms of this crank assembly 60 fold up on one another as it moves from right to left to permit the transfer carriage on which the feed gripper and takeoff gripper are mounted to be moved a significant distance relative to the frame to feed stock without the use of a correspondingly long drive arm and an unmanageably wide frame 12. It can be readily seen that by extending the segmented crank assembly 60, or adding arms as desired, the length of travel of the transfer carriage can be easily increased to accommodate various size printing operations. A positionable tension lever member and gear 77 is mounted on first drive arm 65 to maintain tension in the chain 64.

The segmented construction of the drive crank assembly 60 also provides for a slight or reduced linear movement of the transfer carriage 24 at the positions and times where the feed gripper and takeoff gripper are in the act of gripping and releasing stock to assure proper gripping at these points. The unique construction of the crank assembly produces a harmonious motion in the carriage 24 despite the constant angular speed of the shaft 71 through this time period because when the first arm 65 and second arm 67 are in a straight line extended relationship as shown in FIG. 2, or in a collapsed relationship in a position parallel to rails 22, movement of the main drive gearthrough a certain particular arc will only produce a slight linear movement of the arms and carriage assembly. As the first and second arms reach a position perpendicular to rails 22, however, as shown in hidden lines in FIG. 2, a slight angular movement of the main drive gear will produce a corresponding linear movement of the carriage.

When the crank assembly reaches a left-hand extended position, as shown in the dotted lines in FIG. 2, the carriage assembly 24 is in the second or print position where the sheet of stock 15 is positioned over the printing bed 18 and under the printing head 16 of the printing press for printing. Feed gripper 26 will be moved adjacent the printing bed 18 as registration plate 34 engages stop 38', as shown in FIG. 6, to move feed gripper bar 32 in a similar manner to that described above, over camming surface 42' (FIG. 6). At the same time, a roller 53 on gripper cam follower 51 engages a cam ramp 57 mounted on support member 20 at the third or delivery position to rotate internal cam rod 54 (FIG. 8), in the same manner as previously described, to force open jaws 48 and 50 and release the printed stock for drying.

Movement of the transfer carriage is also controlled by a series of stacked control cams 72 which are formed to activate control switches 73 which are adjacent thereto (FIG. 8). These cams, which are mounted on shaft 71 to rotate with main driven gear 63, will, as they rotate, engage various switches 73 at selected times to thereby activate different operations of the takeoff and also printing press. For example, the operation of a single illustrative control cam 75 and the circuit controlling the speed of the DC motor 61 driving the carriage assembly 24, is shown in FIG. 9. During the feed portion of the movement of the transfer carriage 24, that is, movement between the right hand end and the printing bed with a sheet of stock to be printed, and corresponding delivery of a just-printed sheet of stock, cam 75 closes switch 76 to complete circuit 78', having a variable resistance, through motor 61. This will directly control the motor speed, and thereby the speed of the carriage assembly. When the carriage assembly 24 reaches the delivery position for both the delivery and feed grippers, however, a second cam, such as 80, engages a switch 81 to stop the vacuum to the suction cups and provide positive blowback along with a vacuum holddown on the printing press to positively release the stock 15 (FIG. 5). The cam 75 then acts to allow switch 76 to close on circuit 78 through DC motor 61, which circuit contains a decreased amount of resistance. This decreased resistance 82 will increase the speed of the motor, and therefore the rate of return of the transfer carriage 24 from left to right to its original starting position shown in FIG. 1.

Third and/or fourth cams may be employed, as shown in FIG. 8, so that camming surfaces thereon engage switches as the transfer carriage is returning to its first position, to lower the printing head 16 and activate the printing cycle. By such controls, the transfer of stock from the first or ready position to a second or print position and simultaneous delivery of printed stock to a third or delivery position can be accomplished in synchronization with printing of stock on a printing bed.

In an alternative form or mode, the feed gripper 26 can deliver the stock to the printing bed 18, and by action of similar camming controls, disengage from movement by the drive motor 61 for a sufficient period to allow the printing head 16 of the printing press to descend over the stock maintained in position by the feed bar 32 to print the same. Use of the feed bar 32 to hold the stock down will prevent any movement of the stock and insure exact registration despite repeated printing on the same sheet of stock in multiple colors. The variation in the timing above suggested can, of course, by accomplished by substitution of various shaped cams and a movement of the cams on the shaft 71, on which they are mounted, relative to the switches 73.

While the above invention has been described in relation to a preferred embodiment thereof, it will be apparent to those skilled in the art that this structure is capable of wide variation without departing from the principles of the invention.

We claim:

1. A feed and take off assembly particularly for use in conjunction with a printing press to automatically transfer sheet stock, from a first position, where said stock may be registered, through a second position under a printing head, where said stock may be printed on, and to a third position, including a frame, a first gripper means for contacting and feeding a single sheet of stock from said first position to said second position while maintaining registration of said sheet of stock, second gripper means for removing and delivering said single sheet of stock from said second position to said third position, said first gripper means and said second gripper means being mounted near opposite ends of a transfer carriage, said transfer carriage having a plurality of rollers mounted thereon which engage said frame to facilitate movement of said transfer carriage therealong, said transfer carriage maintaining said first gripper means and said second gripper means in fixed spaced relationship relative to one another during movement, a motor means for driving said transfer carriage, said transfer carriage being driven by a drive crank assembly having one end thereof connected to said motor means and an opposite end thereof connected to said transfer carriage, said drive crank assembly having means for translating angular motion produced by said motor means into linear motion of said transfer carriage bearing said first gripper means and said second gripper means, said motor means being in communication with a control means to determine the rate of movement of said transfer carriage relative to said frame, said control means including circuit selecting cams rotatable about a central axis by said motor means, and circuit controlling switches engaged and activated by said circuit selecting cams to select, at a desired time, a predetermined circuit controlling the speed of the motor means to thereby vary the rate of movement of said transfer carriage relative to said frame thereby providing a single, reliable, unitarily moveable unit for feeding and delivering stock during a printing operation.

2. The feed and takeoff assembly of claim 1 wherein said drive crank assembly comprises a drive arm having one end connected to said motor means, said drive arm being driven in an angular manner relative to said frame by said motor means, a transfer carriage arm fixedly mounted on said transfer carriage and linking arm means operatively connecting said drive arm to said transfer carriage arm, one end of said linkage arm means freely pivotally connected to an outward end of said drive arm and an opposite end of said linkage arm means freely pivotally connected to said transfer carriage arm, said angular movement of said drive arm causing said linkage arm means to pivotally follow said drive arm, said transfer carriage arm following the movement of said linkage arm means, thereby causing a corresponding reciprocal linear movement of said transfer carriage.

3. The feed and takeoff assembly of claim 1 wherein said second gripper means includes an elongated takeoff gripper mounted on said frame and positioned generally transversely to the path of travel of said second gripper means along said frame for movement relative to said frame between said second position and said third position, said takeoff gripper having an upper jaw member and a complementary lower jaw member, said upper and lower jaw members being pivotally connected to one another at a pivotal side of said takeoff gripper, a camming means disposed between said upper jaw member and said lower jaw member near a side opposite said pivotal side, said camming means being angularly movable relative to said takeoff gripper to urge said jaw members to move in opposite angular directions, and elastic means connecting said upper and lower gripper jaws to urge said upper and lower gripper jaws together in closing contact on said sheet of stock.

4. In an apparatus particularly for use in connection with a screen printing press, to feed stock to be printed from a supply position to a bed of said printing press for printing such stock, and having a frame at least extending between said supply position and said press bed and a feed means mounted on said frame for movement therealong to grip said stock near a leading edge thereof and transfer said stock to said printing press bed, the improvement wherein said feed means includes a single, elongated feed gripper arm, said gripper arm being positioned generally transversely to the path of travel of said feed means along said frame, and generally parallel to a surface of said stock, said feed gripper arm being mounted on a registration plate having cam following surfaces formed therein, said registration plate being mounted on a transfer carriage having roller means engaging rails fixed to said frame along the length thereof, said feed gripper arm extending substantially along the leading edge of said stock and moving with said transfer carriage relative to the frame, a plurality of holding means mounted on said feed gripper arm for contacting and lifting said stock,having support means mounted thereon having camming pins fixed thereto to engage said camming surfaces of said registration plate, said registration plate being urged, by resilient means mounted on said transfer carriage adjacent said registration plate, into contact with said camming pins, said camming surfaces moving on said camming pins in response to said urging of said registration plate to cause said plate and said gripper arm mounted thereon to be moved in a vertical direction relative to said frame to contact and lift said stock simultaneously along the length of said gripper arm while maintaining exact registration of said stock relative to said supply position.

5. The improvements set forth in claim 4 wherein said holding means mounted on said feed gripper arm includes a series of suction cups in communication through a passageway formed in said feed gripper arm with a source of a vacuum which may be applied therethrough to stock positioned in said supply position, in such a manner that when said suction cups are brought into contact with said stock said vacuum applied will cause said stock to be lifted and gripped by said feed gripper along the length thereof.

* * * * *

UNITED STATES PATENT OFFICE

CERTIFICATE OF CORRECTION

PATENT NO. 4,031,824

DATED June 28, 1977

INVENTOR(S) : Henry J. Bubley and John R. Krutsch

It is certified that error appears in the above-identified patent and that said Letters Patent are hereby corrected as shown below:

In Column 1, line 2, change "shock" to -- stock --.

In Column 4, line 33, change "is" to -- in --.

In Column 4, line 61, change "spring" to -- springs --.

In Column 4, line 68, change "past" to -- post --.

In Column 5, line 2, after the numeral "45", insert the word -- when --.

In Column 6, line 11, after the numeral "71", insert a -- ( --.

In Column 7, line 16, change "(FIG. 8)" to -- (FIG. 7) --.

In Column 8, line 3, after "course", change "by" to -- be --.

In Claim 4 (column 10, line 9), after the word "stock," insert -- said transfer carriage --.

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*